United States Patent [19]

Horne

[11] 4,055,904

[45] Nov. 1, 1977

[54] AUTOMATIC CRITICAL POINT DRYING APPARATUS

[75] Inventor: John E. Horne, Hyattsville, Md.

[73] Assignee: Tousimis Research Corporation, Rockville, Md.

[21] Appl. No.: 672,923

[22] Filed: Apr. 2, 1976

[51] Int. Cl.[2] ..... F26B 19/00

[52] U.S. Cl. ..... 34/45; 34/66

[58] Field of Search ..... 34/36, 44, 45, 148, 34/43, 51, 54, 66; 250/441, 443

[56] References Cited

U.S. PATENT DOCUMENTS

| | | | |
|---|---|---|---|
| 2,903,589 | 9/1959 | Ladd | 250/311 |
| 3,075,700 | 1/1963 | Bishop, 3rd | 236/DIG. 8 |

FOREIGN PATENT DOCUMENTS

| | | | |
|---|---|---|---|
| 2,150,227 | 10/1971 | Germany | 256/250 |

OTHER PUBLICATIONS

Critical Point Drying Apparatus - Samdri Pvt 3 - Tousimis Research Corp 1975 - Operation & Service Manual.

Scanning Electron Microscopy/1970 - Electron Microscope Symposium - ITT Research Institute - Specimen Preparation Tech.

*Primary Examiner*—John J. Camby

*Assistant Examiner*—Larry I. Schwartz

*Attorney, Agent, or Firm*—Sughrue, Rothwell, Mion, Zinn and Macpeak

[57] ABSTRACT

A critical point drying apparatus for sample preparation in electron microscopy is automated to proceed in order through multiple operational modes in drying the specimen. These modes are: precooling, in which a specimen chamber is cooled; starting, in which the specimen chamber is filled with liquid $CO_2$: purging, in which a limited amount of $CO_2$ passes through the specimen chamber; heating, in which the specimen chamber is heated to elevate pressure to the critical pressure and heat the specimen to the critical temperature; bleeding, in which the specimen chamber is depressurized to atmospheric pressure at a very slow rate; and finishing, in which the chamber is vented and an indicator signals the end of the drying operation. These steps are automatically activated in sequence when desired mode conditions are met or can be selectively controlled in a manual mode.

19 Claims, 6 Drawing Figures

AUTOMATIC CRITICAL POINT DRYING APPARATUS

BACKGROUND OF THE INVENTION

1. Field of the Invention

This invention relates to improvements in critical point dryers for sample preparation in electron microscopy and especially to a fully automatic critical point dryer.

Description of Prior Art

In order to examine biological specimens under a scanning electron microscope, they must be completely dried and coated with a thin conductive layer. It is important that the drying process be accomplished without disturbing the microstructure of the specimen to be examined. Normally this drying is accomplished in one of three manners depending upon the specimens's structure. Air drying by evaporation of the cellular water, while suitable for bacteria or other rigid structures, is detrimental to the structures of many specimens. The surface tension forces, which turn a grape into a raisin during the drying process, cause sufficient distortion in the cell structure of many specimens so as to render them useless. Sublimation or freeze-drying is useful only for very small specimens. Additionally, unless the lengthy technique is followed precisely structural damage from thermal expansion or ice crystal formation often results. The third method utilized is the phase transition or critical point drying which produces consistently reproducible results without the drawbacks of the preceding two methods.

In critical point drying the water contained in a specimen is gradually replaced by a dehydrating fluid such as ethanol or acetone. This maintains the three dimensional hydrated morphology of the structure under study. However, if the ethanol or acetone is now allowed to evaporate its surface tension forces would cause structural damage and destroy the specimen's usefulness and therefore the critical point drying method is utilized.

Critical point drying devices for sample preparation in electron microscopy are known in the art. The prior art critical point dryers utilize the technique of substituting a transitional fluid for the dehydrating fluid in the cell structure and then removing the transitional fluid. The critical point dryers heat and pressurize the specimen until above the critical pressure and critical temperature.

The critical temperature is defined as the temperature above which a gas cannot be liquefied by pressure alone. The critical pressure is the pressure that results when a substance exists as a gas and a liquid in equilibrium at the critical temperature. The critical point of a liquid is when its temperature and pressure are at or above the critical temperature and pressure and the densitites of the liquid phase and vapor phase are identical. This critical point is characterized by an absence of phase boundaries that normally exist between a liquid and its vapor at temperatures and pressures below the critical point. This absence of a phase boundary eliminates the boundary forces which exist when changing a liquid to a gas. It is precisely these boundary forces which cause the destruction of the extremely delicate specimens when changing its internal liquid to a gas below the critical point. Therefore, the solution which is applied in a critical point drying process is to remove the internal liquid from the specimen above its critical pressure and temperature to eliminate the boundary force destruction that would otherwise result.

Although all fluids have a characteristic critical point which should allow direct removal without the use of dehydrating or transition fluids, the critical point temperature and pressure of water is 374.2° C and 218 atmospheres. Achieving these temperatures and pressures would cause severe damage to most bio-organic specimens and therefore a fluid having a lower critical temperature and pressure is normally substituted. Commonly, a dehydrating fluid is used which is miscible with water, for example, ethanol or acetone as an intermediate stage between the specimen containing water and a specimen containing transitional fluid.

Typically, and in the prior art dryers, the transitional fluid commonly used is carbon dioxide ($CO_2$) because it is easy to use, more economical, less noxious and provides consistently better results than other transitional fluids. Its critical temperature and pressure is 31° C and 1,072 psi, respectively, thus reducing the potential for destruction of the specimen structure.

The known instruments and apparatuses for critical point drying of specimens include, of course, a specimen chamber to which is connected a supply of the transitional fluid, $CO_2$, with various regulating valves, temperature gages and a means for heating the chamber. A skilled technician must carefully control the application, heating, pressurizing and removal of the transitional fluid, thus requiring not only time but constant attention. Occasionally, automatic controls for one of the multi-steps in handling a specimen has been provided, but to the applicant's knowledge there has been no fully automated critical point dryer which eliminates the need for constant operator attention.

SUMMARY OF THE INVENTION

This invention provides an automatic critical point dryer for the automation of the critical point drying cycle in electron microscopy specimen preparation. However, this invention can also be completely and independently operated manually. The dryer includes a specimen chamber mounted in a housing with indicators of the various steps in the drying cycle as well as pressure and temperature monitors and manual control switches if it is desirable to utilize the manual mode. The transitional fluid, $CO_2$, is connected to the specimen chamber to both cool the chamber and fill the chamber with transitional fluid during the cycle. In addition, heaters are provided for increasing the temperature and pressure of the transitional fluid to above the critical point in the specimen chamber. Sensors are provided to control each of the steps of cooling, filling, purging, heating, bleeding and venting during the specimen preparation.

The first step in the critical point drying operation is to cool the chamber to a temperature which will condense the transitional fluid to be added later. This cooling is accomplished by flowing $CO_2$ around the chamber and evaporating it in a heat exchange relation with the chamber. The next step is placing the treated specimen (which has previously been dehydrated with the dehydrating fluid) in the specimen chamber and filling the chamber with liquid $CO_2$. Once the fill step has been initiated all other operations are completely automatic and progress without the necessity of an operator. The chamber is automatically filled to a desired level and then purged to replace the dehydrating fluid in the specimen with liquid $CO_2$. The purging is controlled over a definite time period on a preset time cycle. At the end of the purge step, a heating step is initiated to pressurize the chamber as well as heat the transitional fluid. Once above the critical point, the temperature is maintained while the chamber pressure is reduced or bled-off very slowly. When the pressure drops to zero, the chamber is then vented to release any residual pressure that may hinder removal of the chamber lid. These operations are accomplished automatically through a sequencing relay in response to sensing monitors or can be accomplished by manual operation of the toggle switches which control the process steps. Additional features in the combination are solenoid operating valves in conjunction with a chamber lid interlock system to prevent flooding of the chamber prior to sealing the chamber and a sequence advance button that can provide a step change even when in the automatic operations mode.

DETAILED DESCRIPTION OF THE PREFERRED EMBODIMENT

Figure 1:
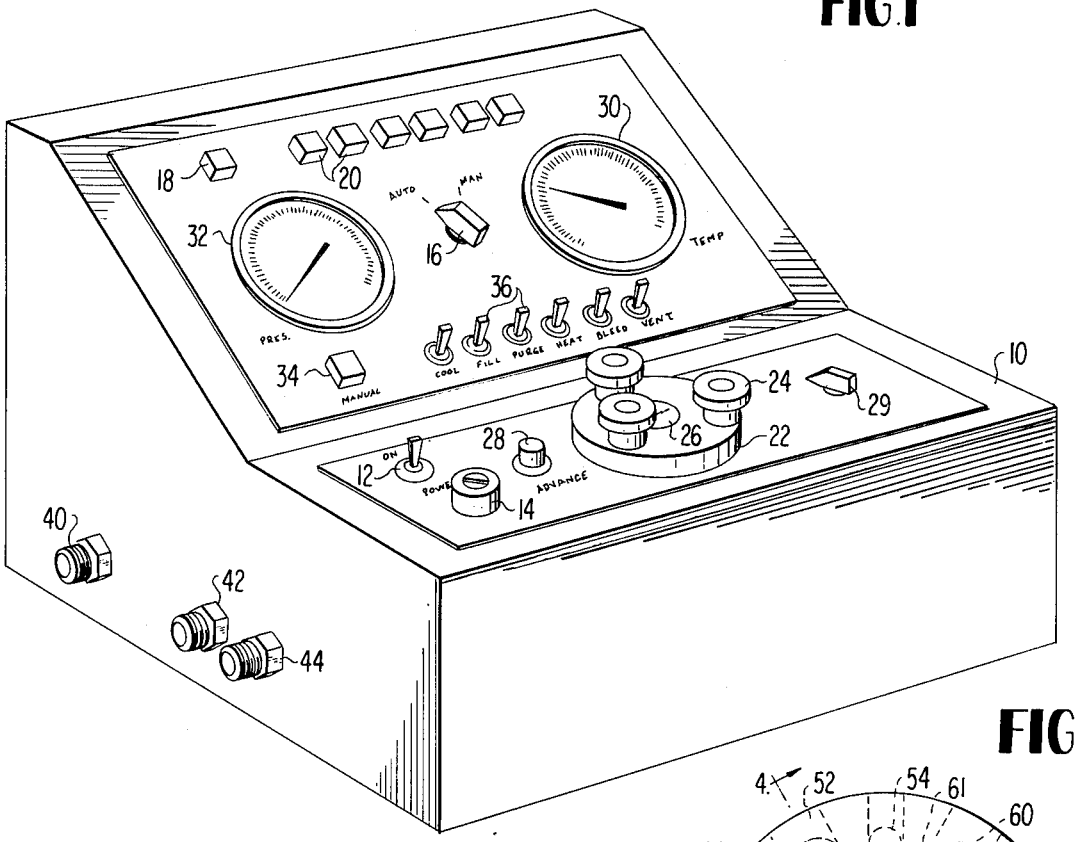
FIG. 1 is a perspective view of the outside of the critical drying point apparatus showing the automatic cycle mode indicator lights, the manual switches, the specimen chamber, and the pressure and temperature gauges primarily for the manual operation.

Referring now to the drawings wherein like reference numerals refer to similar parts in the several views, FIG. 1 is a perspective view showing the external configuration of one embodiment of the automated critical point drying apparatus. A housing 10 encloses the internal valves, wiring, piping, switches and relays which make up the automatic critical point dryer. Power switch 12 applies electrical power to the dryer through a fuse 14. Auto/manual select switch 16 determines the mode of operation of the dryer. If in the automatic mode the automatic mode light 18 will be illuminated as will be one of the operation indicator lights 20. These lights indicate the individual operation which is being undertaken in the specimen chamber. A specimen chamber 21 (FIGS. 2 and 3) includes a cover or top 22 secured by securing knobs 24 and is provided with a glass viewing port 26 for viewing the specimen during drying operations. To enhance viewing of the specimen through port 26, a light source directs light through a bottom glass port 27.

An advance switch 28 allows manual advancement of the operation which is in progress as indicated by operation indicator lights 20. Timer selector 29 presets the length of duration of the purge cycle when in the automatic mode. Temperature gauge 30 and pressure gauge 32 provide a visible indication of the conditions occurring in the specimen chamber. When the auto/manual selector switch 16 is placed in the manual mode the manual mode light 34 is illuminated and manual operation selectors 36 operate to determine which operational steps are employed. A transitional fluid, for example, carbon dioxide ($CO_2$), is supplied to the dryer at inlet port 40. The $CO_2$ is exhausted from the cooling cycle through cool port 42 and from the specimen chamber through purge port 44.

Figure 2:
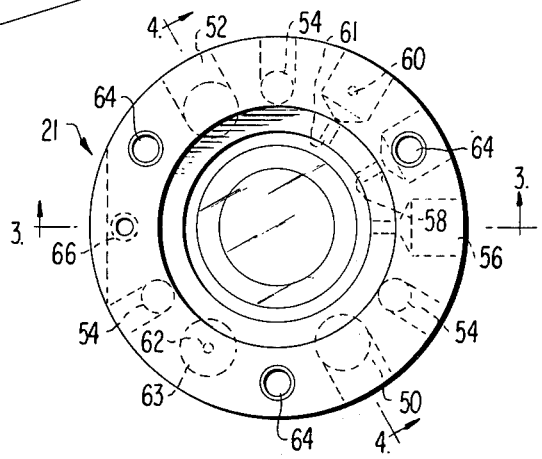
FIG. 2 is a top view of the specimen chamber.

FIG. 2 is a top view of the specimen chamber. The $CO_2$ is circulated to cool the chamber walls by passing into cool-in port 50 through the walls of the specimen chamber and connecting line 51 and out through cool-out port 52. Heater means, typically wire-wound resistance heaters 54, are mounted in the wall of the specimen chamber to heat the transition fluid above the critical point. The chamber is also provided with a transition fluid inlet 56 and an outlet 58 which allow the $CO_2$ to fill and flow through the chamber. A transition fluid level sensing means, for instance, a thermistor 60 mounted in a chamber connected to a level fill sensing opening 61 is used to provide an indication of the level of transition fluid in the specimen chamber. A temperature sensor 62 in wall 63 is connected to temperature gauge 30 to provide an indication of the specimen chamber temperature. Mounting studs 64 extend upward through the chamber top 22 and in conjunction with internally threaded securing knobs 24, fixably and sealably mount the chamber top 22 to the specimen chamber. An interlock switch 66 operated by pin 67 (FIG. 3) prevents inadvertent filling of the chamber prior to securing the chamber top 22.

Figure 3:
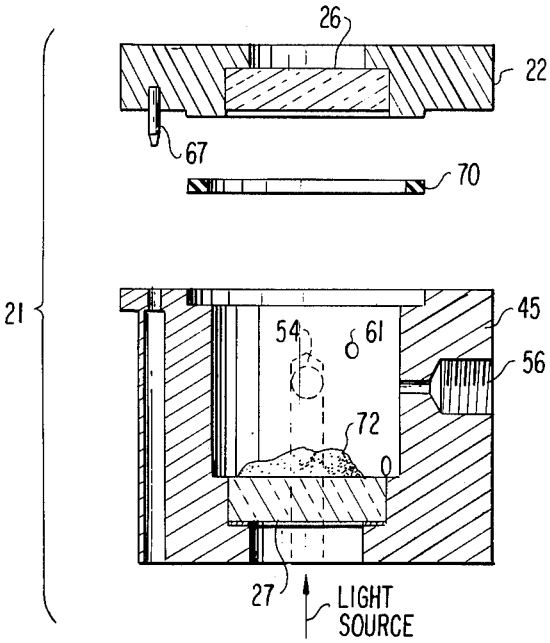
FIG. 3 is a cross-sectional view of the chamber taken along line 3—3 of FIG. 2.

FIG. 3 is a cross-sectional view of the specimen chamber 21, showing the chamber base 45, sealing gasket 70 and the chamber top 22. The location of level sensor 60 insures that the specimen 72 is always covered with transitional fluid during the filling and purging operational steps.

Figure 4:
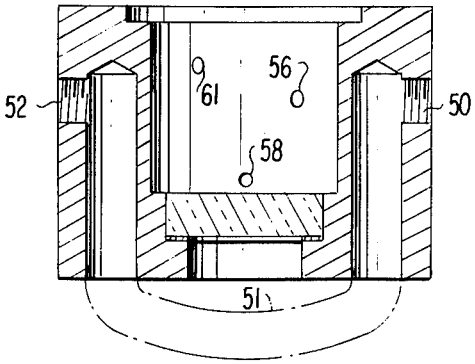
FIG. 4 is a cross-sectional view of the chamber taken along line 4—4 of FIG. 2.

FIG. 4 is a second cross-sectional view along lines 4—4 of the chamber face 45. This view details the coolant flow through the walls of the specimen chamber as well as the relative position of inlet 56, outlet 58 and the level sensor opening 61.

Figure 5:
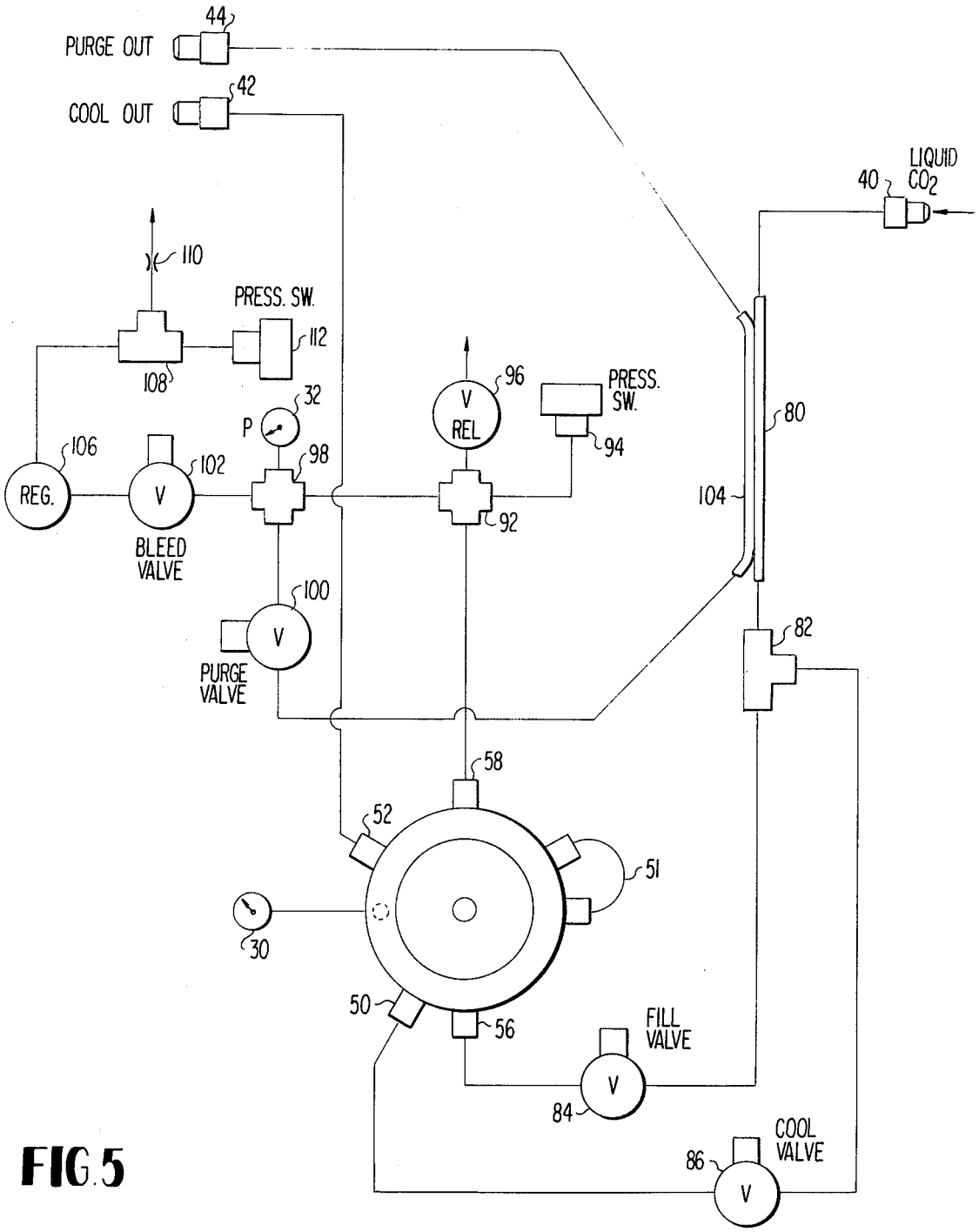
FIG. 5 is a fluid flow diagram for the transitional fluid, liquid $CO_2$.

FIG. 5 is a schematic diagram showing the flow of transition fluid through the specimen chamber and the various control valves. The transition fluid is also utilized to cool the specimen chamber through the cooling circuit shown. The transition fluid, liquid $CO_2$, is provided at inlet 40 and flows through heat exchanger 80 to the tee 82. The liquid $CO_2$ is then piped to two solenoid operated valves - the fill valve 84 and the cool valve 86. When their solenoids are energized the valves supply the transition fluid to the specimen chamber at either cool-in port 50 or inlet 56. When the cool valve 86 is energized the liquid $CO_2$ is evaporated and ducted throughout the walls of the specimen chamber. The flow is from the cool-in port 50 through line 51 to the cool-out port 52 where the warmed vaporized carbon dioxide is ducted out of the apparatus at the cool port 42.

Energization of fill valve 84 allows the liquid $CO_2$ to be fed directly into inlet 56 to fill or purge the specimen chamber. During purging liquid $CO_2$ flows from outlet 58 to the junction 92. The pressure of the fluid in junction 92 is sensed by pressure switch 94 and if the pressure reaches a predetermined undesirable level a pressure release valve 96 will automatically vent the transition fluid to atmosphere. Junction 92 is in fluid communication with junction 98 to which pressure gauge 32 is connected. Due to the direct connection between the outlet to the specimen chamber and the pressure gauge 32, the internal pressure of the specimen chamber will be read by the pressure gauge.

Connected to junction 98 are two further solenoid energized valves - purge valve 100 and bleed valve 102. When energized, purge valve 100 allows the transition fluid to expand into evaporator section 104, which vaporizes the fluid causing its temperature to drop in heat exchanger 80 thereby cooling the incoming transition fluid, and then exit through purge port 44. When the bleed valve 102 is energized it allows the transition fluid to flow through regulator 106 and tee 108, and then to be exhausted through vent 110. The flow through tee 108 is sensed by pressure switch 112 which provides an indication when the pressure has bled down to that of the atmosphere. Thus, it can be seen by controlling the solenoid operated fill valve 84, cool valve 86, purge valve 100 and bleed valve 102 the specimen chamber can be controllably cooled, filled, purged, pressurized, bled, and vented automatically.

Operation

Figure 6:
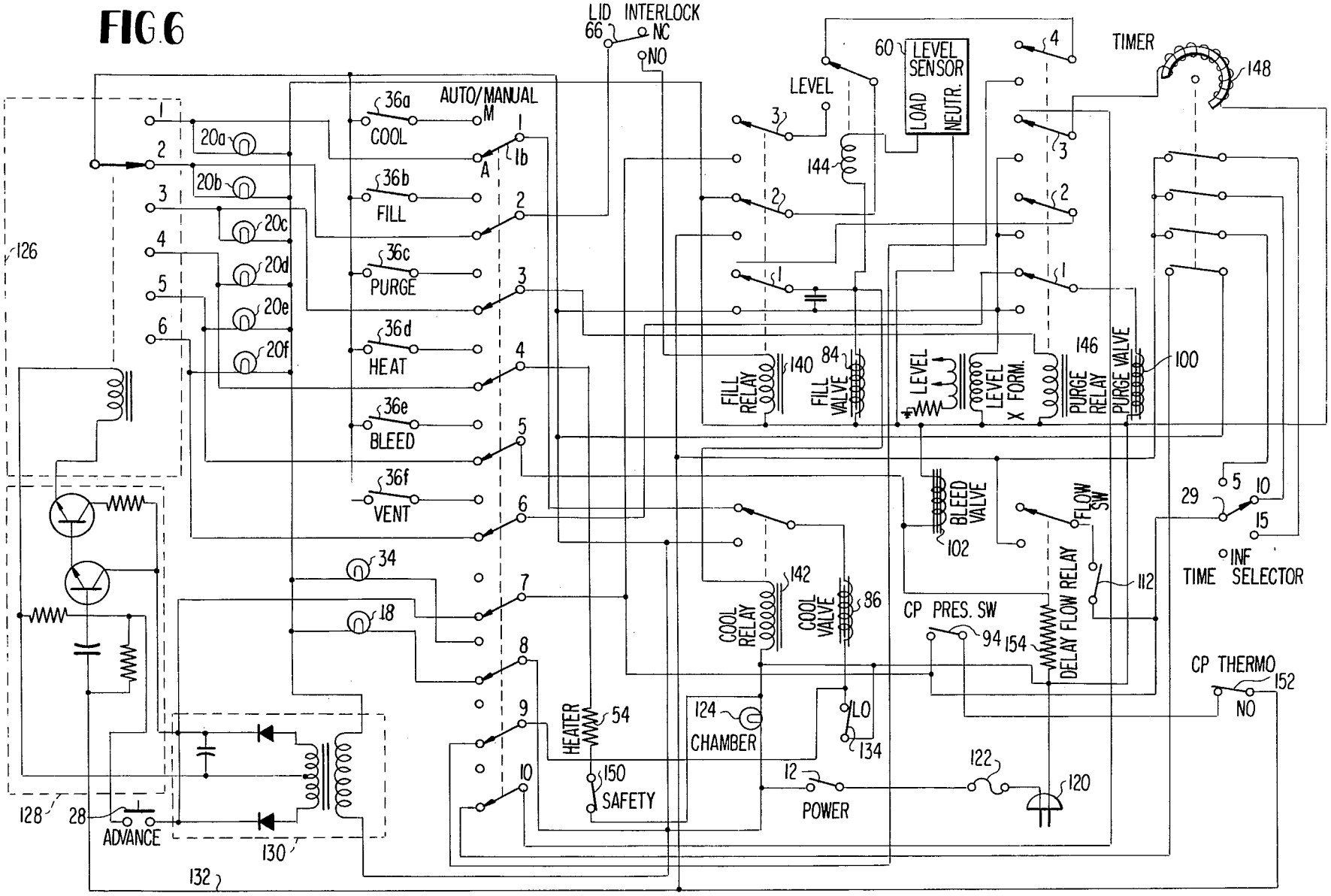
FIG. 6 is an electrical schematic diagram for automatic and manual control of the apparatus of this invention.

The operation of the automatic critical point dryer can be more clearly comprehended by reference to FIG. 6 which is an electrical schematic detailing the interconnection of one embodiment of the present invention. Power is applied by closing power switch 12 and connecting plug 120 to a suitable power source. Fuse 122 protects the circuit in the event of a power overload or short circuit. Closing power switch 12 will result in illumination of the chamber light 124 and illumination of either automatic mode light 18 or manual mode light 34 depending upon the position of auto/-manual select switch 16 (shown in the automatic position). Additionally, one of the operation indicator lights 20 will be illuminated, which one depending upon the position of sequencing switch 126. The sequencing switch steps to a new position from the preceding switch position upon receipt of a signal from the relay driver amplifier 128. The necessary power for both the relay driver amplifier 128 and the sequencing switch 126 is provided by the power supply 130. It can be seen that upon the application of a positive voltage to the relay driver amplifier 128, either through closing advance switch 28 or through line 132, the sequencing switch 126 will move to the next higher numbered position, returning to position 1 after position 6.

In the manual mode of operation, indicated by M on the auto/manual select switch 16, the sequencing of dryer operations is controlled by the manual operation selectors 36 with the additional flexibility that any combination of the selectors can be activated at any given time. The first step in the manual operation is to cool the specimen chamber 45 to a suitably cold temperature.

To initiate cooling operations with the manual select switch 16 in the manual position (the opposite of the position in FIG. 6), the cool selector **36*a* is closed. It can be seen that line voltage is applied directly to the solenoid of cool valve 86, through the low temperature thermostat 134 to the other side of the electrical supply. The energization of the cool valve results in the passage of liquid carbon dioxide through the cooling passages in the specimen chamber where its evaporation cools the chamber. The low temperature thermostat is adjusted to 5° C such that when the specimen chamber temperature falls below 5° C the thermostat opens, deenergizing cool valve 86 and cutting off the flow of coolant. If the chamber temperature should rise above 5° C, the thermostat will again close, energizing cool valve 86** and beginning the flow of coolant once more.

Once the chamber has been cooled, the already dehydrated specimen (saturated with acetone or ethanol) is placed in the specimen chamber. The chamber top is replaced such that the interlock pin 67 closes interlock switch 66 when the securing knobs 24 have been properly tightened. When the interlock switch 66 (illustrated in the opened position) is closed, the closing of fill selector **36*b* will initiate chamber filling operations. Voltage is applied through the interlock switch 66 to energize fill relay 140. Relay 140 contains three separate sets of contacts (shown in the deenergized position) which are closed when the relay is energized. Contact 1, when closed, applies line voltage to fill valve 84, cool relay 142 and level relay 144. Energization of fill valve 84 allows liquid $CO_2$ to flow into the specimen chamber through inlet 56. Energizing cool relay 142 (shown in the deenergized position) causes power to be supplied to the cool valve 86 just as in the "cool step." Thereafter, during fill operations the specimen chamber temperature is maintained at or below 5° C. Energization of level relay 144 is only possible when level sensor 60** is a conducting path to ground. This is of no consequence during manual operations but does serve a useful function in the automatic sequencing.

Once it has been observationally determined that the specimen chamber is full, the fill selector would be placed in the non-operative position and the purge operation is ready to be initiated. Closing the purge selector **36*c* will apply power to and energize purge relay 146 which has four pairs of contacts. Closing of contact 1 applies line power to purge valve 100 allowing transition fluid to flow from outlet 58 through the purge valve, through the restriction orifice 104 and out the purge port 44. Closing contact 2 energizes the fill valve 84, cool relay 142 and level relay 144. It can be seen then that as long as contact 2 is closed the cool relay and valve will maintain the chamber temperature at 5° C, the fill valve will be opened and the level sensor 60 will monitor and maintain a full specimen chamber. Contact 3 applies line voltage to timer 148 although the timer output and relays are not utilized in the manual mode. Similarly, contact 4 is not utilized during manual operations. As was noted in the description of FIG. 5 after the initiation of the purge step, the purged transition fluid is expanded at the evaporator section 104 and is used to cool the incoming transition fluid (at room temperature) to the chamber temperature (approximately 5° C) by means of heat exchanger 80. This insures a continuing supply of liquid transition fluid even when a large portion of the fluid which enters at port 40** may in fact be gaseous. The purge step continues as long as the purge selector is on and is normally continued for a length of time sufficient to purge all traces of the dehydrating fluid from the specimen.

After completion of the purge step, the manual heating step is accomplished by closing selector **36*d*. At this point all valves are in their deenergized or closed position and heater 54 is energized through safety thermostat 150 which is set at 50° C to protect the dryer should the heat mode be inadvertently initiated without sufficient fluid in the chamber. The object of the heating mode, of course, is to heat and pressurize the specimen chamber to a point at or above the critical point. Pressure in the specimen chamber is limited to 1,400 psi, well above the 1,072 psi critical pressure of carbon dioxide and, if the 1,400 psi limit is exceeded, pressure relief valve 96 is actuated to vent the excess pressure. During the automatic mode critical point pressure switch 94 and critical point temperature switch 152 are placed in series such that the relay driver amplifier 128 is provided a sequence advance signal when the specimen chamber pressure is 1,300 psi and the temperature is 38° C, both substantially above the critical point parameters of carbon dioxide. During the manual mode, of course, the heating is continued until the pressure gauge 32 and temperature gauge 30** indicate that the critical point has been reached. Upon reaching the critical point there is no phase boundary between the liquid and gaseous phases such that by slowly reducing the chamber pressure the carbon dioxide can be removed as a gas without effecting the three dimensional specimen morphology.

The bleed step is initiated by closing selector **36*e* which applies power to bleed valve 102. This allows the transition fluid (which is maintained as a gas because the temperature is above the critical point) to pass through regulator 106 and to be vented through vent 110. The regulator is set to regulate the output pressure at 40 psi which establishes a proper bleed flow through vent 110. Selector 36*e* also energizes the delay flow relay 154 which after a thirty second time delay energizes low pressure switch 112. In the automatic mode low pressure switch 112 provides a sequence advance signal to the relay driver amplifier 128** when the chamber pressure drops below 25 psi. After completion of the bleed step, the specimen is completely dried and devoid of water, dehydrating fluid, transitional fluid and may be removed.

To facilitate removal, vent selector **36*f* is closed which energizes purge valve 100** insuring that the internal specimen chamber pressure is equal to atmospheric pressure. At this point the chamber top would be removed and the dried specimen would be ready to be given its thin metal coating and placed in the electron microscope.

A feature of the applicant's invention hitherto unknown in critical point dryers is the ability to place it in an automatic mode which after setting the initial conditions will complete the drying process without further need of supervision or control. For automatic control the auto/manual select switch 16 is placed in the automatic position and the desired purge time is set on time selector 29. The sequence advance button 28 is actuated causing sequencing switch 126 to apply power to operation indicator light **20*a*. This begins the cooling sequence which is accomplished automatically. When the chamber temperature has stabilized at 5° C the specimen is placed in the specimen chamber 45 and the chamber top 22 is secured. At this point the complete automated critical point drying operation is initiated by pressing the sequence advance button. This provides a control signal to the relay driver amplifier 128 which sequences the sequences the sequencing switch 126 from position 1 to position 2** (as illustrated).

The fill sequence is begun just as in manual operation with the specimen chamber temperature maintained at 5° C. The level sensor 60, a thermistor type fluid level sensor, provides a sequence advance signal to the relay driver amplifier when the chamber has been filled. The sequencing switch 126 advances to the purge operation, operating in a similar manner to the manual operation. As mentioned before, contact 3 of purge relay 146 energizes timer 148 and after the time interval preset on time selector 29 has passed, a sequence advance signal is applied through contact 7 of the auto/manual select switch to the relay driver amplifier 128. Contacts 4 not only energize the cooling stage but maintain the transition fluid level inside the specimen chamber to that of level sensor 60.

After timer 148 has provided a sequence advance signal to the relay driver amplifier 128, the sequencing switch 126 advances to activate the heat cycle. Just as in the manual control mode, the chamber valves are deenergized and the chamber heated to a temperature and pressure above the critical point.

As mentioned previously when the chamber pressure exceeds 1,300 psi and the temperature exceeds 38° C a sequence advance signal is applied to the relay driver amplifier 128. The sequencing switch 126 advances to the bleed cycle and the $CO_2$ vapor is controllably released from the specimen chamber. The thirty second delay flow relay 154 is also energized and contact is made thirty seconds after initiation of the bleed cycle. This is to prevent the transient pressure drop at the beginning of the bleed cycle from prematurely causing low pressure switch 112 to indicate the end of the bleed cycle. Without this delay there is a possibility that a premature advance signal would be transmitted to the relay driver amplifier with the result that instead of the chamber being slowly bled, the chamber would be directly vented to the atmosphere resulting in destruction of the specimen. Therefore, only after the thirty second time delay is relay 154 closed, applying power to low pressure switch 112 which in turn provides a sequence advance signal when the chamber pressure drops below 25 psi.

Again, the sequencing switch 126 is actuated by relay driver amplifier 128 moving to the sixth and final position, initiating the vent cycle. Here as in the manual stage the purge valve is opened to insure there is no further pressure differential between the chamber and the atmosphere to facilitate removal of the chamber top. As before the specimen, completely dried, would be removed to be further processed for the electron microscopy. As noted earlier in this embodiment when in the manual mode, any selector or combination of selector switches can be closed in any order thus providing a high degree of flexibility when manual operation is desired. In the manual mode, actuation of the advance switch 28 will cause sequencing switch 126 to continue to advance with the particular cycle that is set in the automatic mode being indicated by the operation indicator lights 20. At any time during manual operations the auto/manual select switch can be changed from manual to automatic thus engaging the operation that the sequencing switch 126 has been sequenced to, as indicated by the indicator lights 20. Hence if, during the purge cycle in the automatic mode, a visual observation of the specimen indicates a need to continue the purge cycle, the manual purge selector **36*c* could be actuated and the auto/manual select switch changed over to manual. This would continue the purge cycle until either selector 36*c*** was disengaged or the auto/manual select switch was returned to the automatic mode and an advance signal sent to the relay driver amplifier.

Therefore, the automated critical point drying apparatus described and claimed hereinafter, offers a high degree of flexibility in meeting the precise specimen preparations required for high resolution electron microscopy. Furthermore, with minor changes (in the pressure and temperature limit switches, primarily) different transition fluids could also be utilized where specific specimens so require. Although the invention has been described with respect to one embodiment, it is not so limited and many uses of and variations upon the embodiment will be obvious to those in the art in view of this invention. Therefore, the invention is limited only by the scope of the hereinafter appended claims.

What is claimed is:

1. In a critical point dryer for specimen preparation in electron microscopy, said specimen being dehydrated in a dehydrating fluid, said dryer including a specimen chamber in which said dehydrating fluid containing specimen is inserted, cooling means for cooling said chamber, filling means for filling said chamber with a transitional fluid having a critical temperature and critical pressure, purging means for purging said chamber of said dehydrating fluid, heating and pressurizing means for heating said transitional fluid above said critical temperature and pressurizing said transitional fluid above said critical pressure, bleeding means for controllably equalizing said chamber to atmospheric pressure, venting means for venting said chamber directly into the atmosphere, the improvement comprising:

automatic means for automatically and sequentially controlling said cooling means, said filling means, said purging means, said heating and pressurizing means, said bleeding means and said venting means.

2. The critical point dryer of claim 1 further comprising:

manual means for manually controlling said cooling means, said filling means, said purging means, said heating means, said pressurizing means, said bleeding means and said venting means.

3. The critical point dryer of claim 2 further comprising:

auto/manual selecting means for controllably selecting between said automatic means and said manual means.

4. The critical point dryer of claim 1 wherein said cooling means includes temperature sensing means for operating said cooling means and maintaining a predetermined chamber temperature.

5. The critical point dryer of claim 1 wherein said filling means further comprises level sensing means for operating said filling means and maintaining a predetermined quantity of transition fluid in said chamber.

6. The critical point dryer of claim 1 wherein said purging means includes timer means for operating said purging means over a predetermined time of operation.

7. The critical point dryer of claim 1 wherein said heating and pressurizing means comprises temperature sensing means for detecting a value of transitional fluid temperature a predetermined amount above said critical temperature, and pressure sensing means for detecting a value of pressure a predetermined amount above said critical pressure, said automatic means being responsive to a coincidence of said detected temperature and pressure values for activating said bleeding means.

8. The critical point dryer of claim 1 wherein said heating and pressurizing means includes overheat protection means for preventing said heating and pressurizing means from heating said fluid beyond a predetermined temperature.

9. The critical point dryer of claim 1 wherein said heating and pressurizing means includes pressure limit means for preventing said transitional fluid from exceeding a predetermined pressure.

10. The critical point dryer of claim 1 wherein said heating and pressurizing means comprise resistance heaters in said specimen chamber.

11. The critical point dryer of claim 1 wherein said purging means includes means for cooling said filling means.

12. The critical point of claim 1 wherein said automatic means further comprises advancing means for controllably initiating a sequence of steps to sequentially control operation of said filling means, said purging means, said heating and pressurizing means, said bleeding means and said venting means in response to sensed conditions of chamber fill, time, heat and pressure, and bleed pressure.

13. The critical point dryer of claim 1 in which flow of the transitional fluid in all the means is by solenoid operated valves.

14. The critical point dryer of claim 1 wherein the purging means includes an evaporator section in a purge discharge line in heat exchange relationship with an incoming transitional fluid line.

15. The critical point dryer of claim 1 wherein the heating and pressurizing means includes electric heaters in the walls of the specimen chamber.

16. The critical point dryer of claim 1 wherein the cooling means includes cooling passages in the walls of the specimen chamber.

17. The critical point dryer of claim 9 wherein the pressure limit means includes a pressure relief valve.

18. The critical point dryer of claim 6 wherein the timer means is adjustable to automatically and selectively predetermine the purging time.

19. The critical point dryer of claim 1 wherein the specimen chamber includes a lid interlock connected to prevent accidental chamber pressurization.

* * * * *